US007364112B1

(12) United States Patent
Formon

(10) Patent No.: US 7,364,112 B1
(45) Date of Patent: Apr. 29, 2008

(54) PLUG SYSTEM IN A DISPENSER THAT DISPENSES MATERIAL FROM A ROLL OF ABSORBENT MATERIAL

(75) Inventor: John S. Formon, Appleton, WI (US)

(73) Assignee: SCA Tissue North America, Neenah, WI (US)

( * ) Notice: Subject to any disclaimer, the term of this patent is extended or adjusted under 35 U.S.C. 154(b) by 0 days.

(21) Appl. No.: 11/647,322

(22) Filed: Dec. 29, 2006

(51) Int. Cl.
*B65H 75/18* (2006.01)

(52) U.S. Cl. ..... 242/599.4; 242/564.1

(58) Field of Classification Search ..... 242/599, 242/599.4, 564, 564.1, 564.2, 564.3, 565
See application file for complete search history.

(56) References Cited

U.S. PATENT DOCUMENTS

| | | | | | |
|---|---|---|---|---|---|
| 498,900 | A * | 6/1893 | Hicks | 242/565 |
| 689,834 | A * | 12/1901 | Tilton | 242/599.4 |
| 1,592,784 | A * | 7/1926 | Smith | 242/599.4 |
| 4,690,345 | A | 9/1987 | Cotey | |
| 5,314,134 | A | 5/1994 | Harris et al. | |
| 5,377,831 | A | 1/1995 | Crooks | |
| 5,513,820 | A | 5/1996 | Meyer | |
| 5,597,135 | A | 1/1997 | Vandersteene | |
| 5,676,331 | A | 10/1997 | Weber | |
| 5,938,142 | A * | 8/1999 | Halperin | 242/599.4 |
| 2005/0092865 | A1 * | 5/2005 | Neri | 242/599.4 |

FOREIGN PATENT DOCUMENTS

| | | |
|---|---|---|
| EP | 1 064 876 | 3/2001 |

* cited by examiner

*Primary Examiner*—William A Rivera
(74) *Attorney, Agent, or Firm*—Young & Thompson

(57) ABSTRACT

A system used to rotatably support a roll of absorbent material within a dispenser. The system includes a plug pre-packaged only in one end of a core of a roll of absorbent material to be dispensed from the dispenser. The other end of the core is insertable into a boss extending from a wall of the dispenser. The plug mates with a hub member having a complimentary shape to that of the plug. The hub member is rotatably supported within an arm connected to a wall of the dispenser.

11 Claims, 7 Drawing Sheets

PLUG SYSTEM IN A DISPENSER THAT DISPENSES MATERIAL FROM A ROLL OF ABSORBENT MATERIAL

BACKGROUND OF THE INVENTION

1. Field of the Invention

The invention relates to a plug system that is used in a dispenser for dispensing sheets of material from a roll of absorbent material, as well as a method for reloading the dispenser, and a dispenser having the plug system.

2. Description of the Related Art

In conventional dispensers, the roll of sheet material dispensed from the dispenser is fitted with a male plug.

For such dispensers, the manufacturer of the absorbent material usually supplies rolls of product to be dispensed with the plugs already inserted in respective rolls. In certain dispensers of this type, the plug is only in one end of the roll so that the end user can easily determine which end goes where in the dispenser.

U.S. Pat. No. 5,676,331 is a dispenser of the male plug type. However, in such dispensers, axles on which the roll rotates are fairly thin and are subject to breaking off from the plug body or subject to deforming. This may occur either during shipping or when the roll is being loaded into the dispenser.

Several attempts have been made to address the above-noted problems including adding a special packing material to the cases of rolls to protect the axles during shipping. However, such packing materials are costly and only protect the axles during shipping. After shipping, this packaging constitutes a waste product that needs to be disposed.

Moreover, the axles are still subject to breakage or deformation when a roll of absorbent material containing the male plug is installed into a dispenser.

In addition, attempts have also been made to use specially designed plugs to ensure a sales right for the manufacturer of the plug. U.S. Pat. No. 5,597,135 to Vandersteene is a dispenser of that type. However, the Vandersteen plug system is complicated and requires various interconnecting parts.

SUMMARY OF THE INVENTION

An object of the invention is to overcome one or more of the above-described shortcomings of the prior art, or to alleviate one or more of those shortcomings of the prior art at least in part.

Another object is to have a relatively simple device for rotatably supporting a roll of absorbent material so that the roll of material can be loaded and reloaded quickly and easily.

BRIEF DESCRIPTION OF THE DRAWINGS

The above and other objects and advantages of the invention will be described below with respect to the accompanying drawings, in which.

DETAILED DESCRIPTION OF PREFERRED EMBODIMENTS

Figure 1:
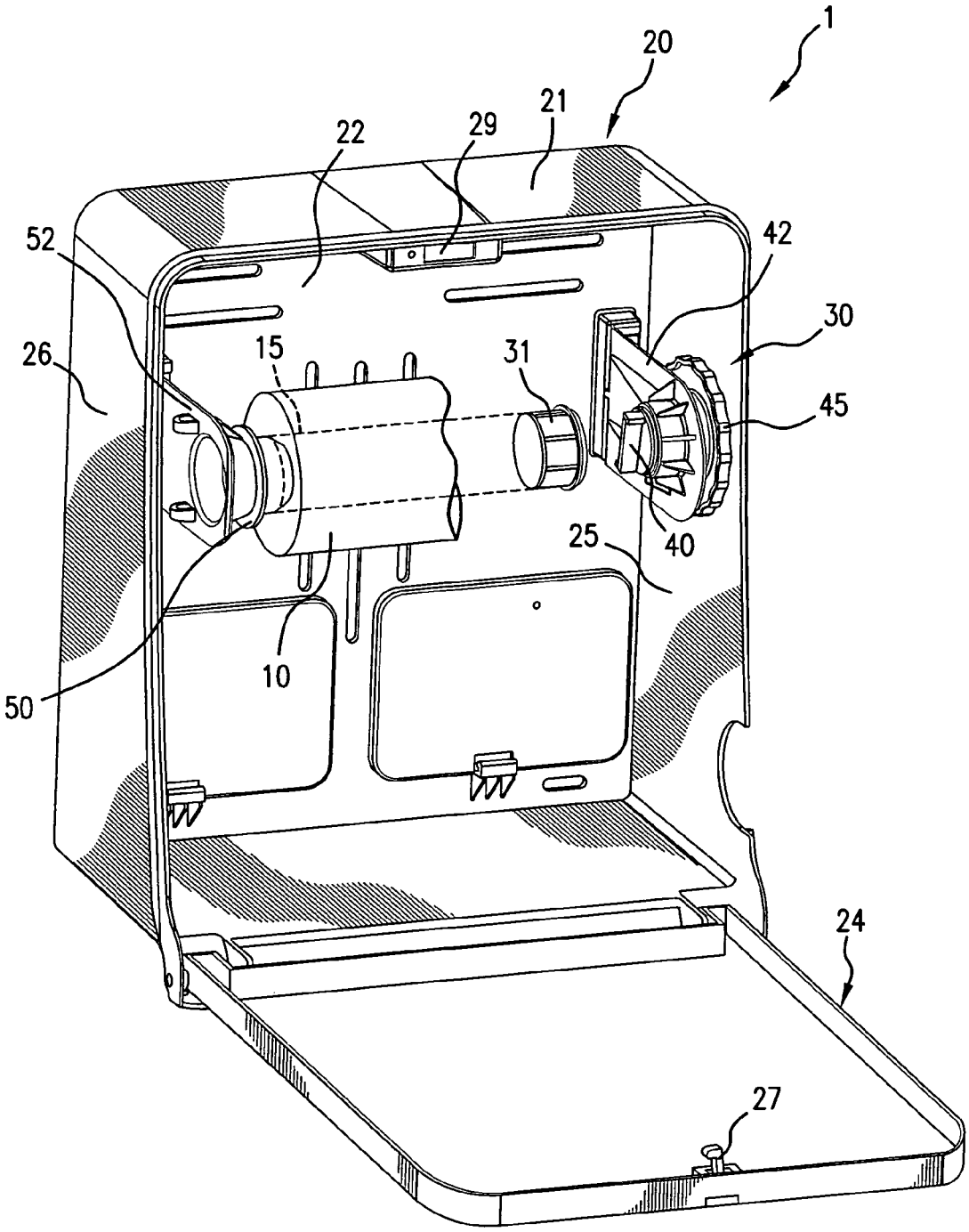
FIG. 1 is a perspective view of an embodiment of a dispenser according to the invention.

FIG. 1 shows a dispensing device 1 for dispensing sheets of material from a roll of absorbent material, e.g. roll 10. The dispenser 1 includes a dispenser housing 20 having a top wall 21, rear wall 22 and a front wall 24 formed as a cover connected to the rear wall 22. A pair of side walls 25, 26 are between the front and rear walls 24, 22. The front and top walls may be releasably connected through locking member 27 on front wall 24 and mating locking member 29 on top wall 21.

Figure 2:
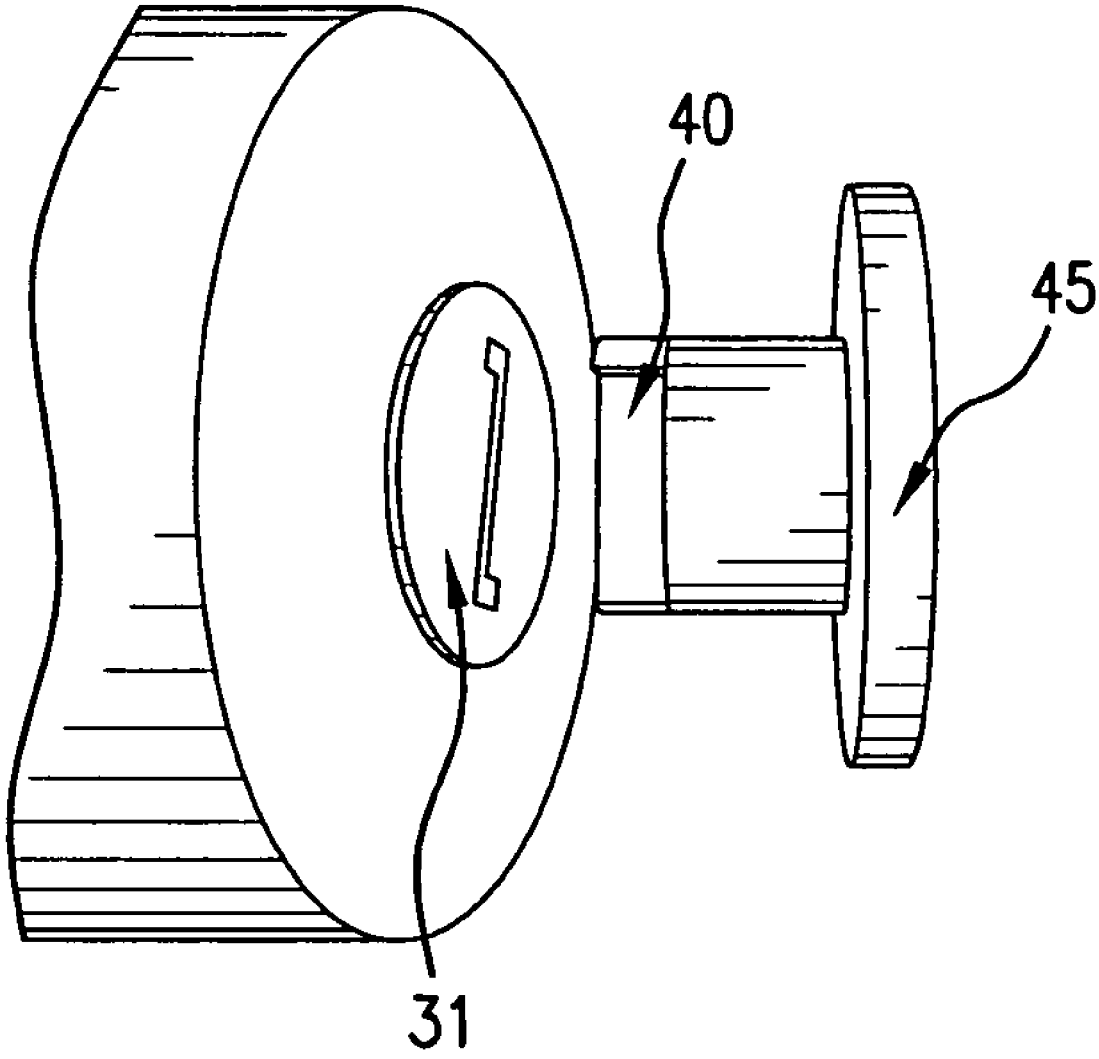
FIG. 2 is a perspective view of the female plug inserted into a core, but before connection to the male key.

The roll 10 may be a conventional roll of toilet paper or paper towels wound around a cardboard core 15 and may be rotatably mounted within the dispenser housing 20. A plug 31, is insertable at least part way into at least one end of the core 15. In the embodiment of FIG. 2, the plug 31 is a female plug and is on the right hand side of the roll 10. However, the plug 31 could be a male and/or could be on the left hand side of the roll 10 or even on both sides of the roll 10.

Figure 3:
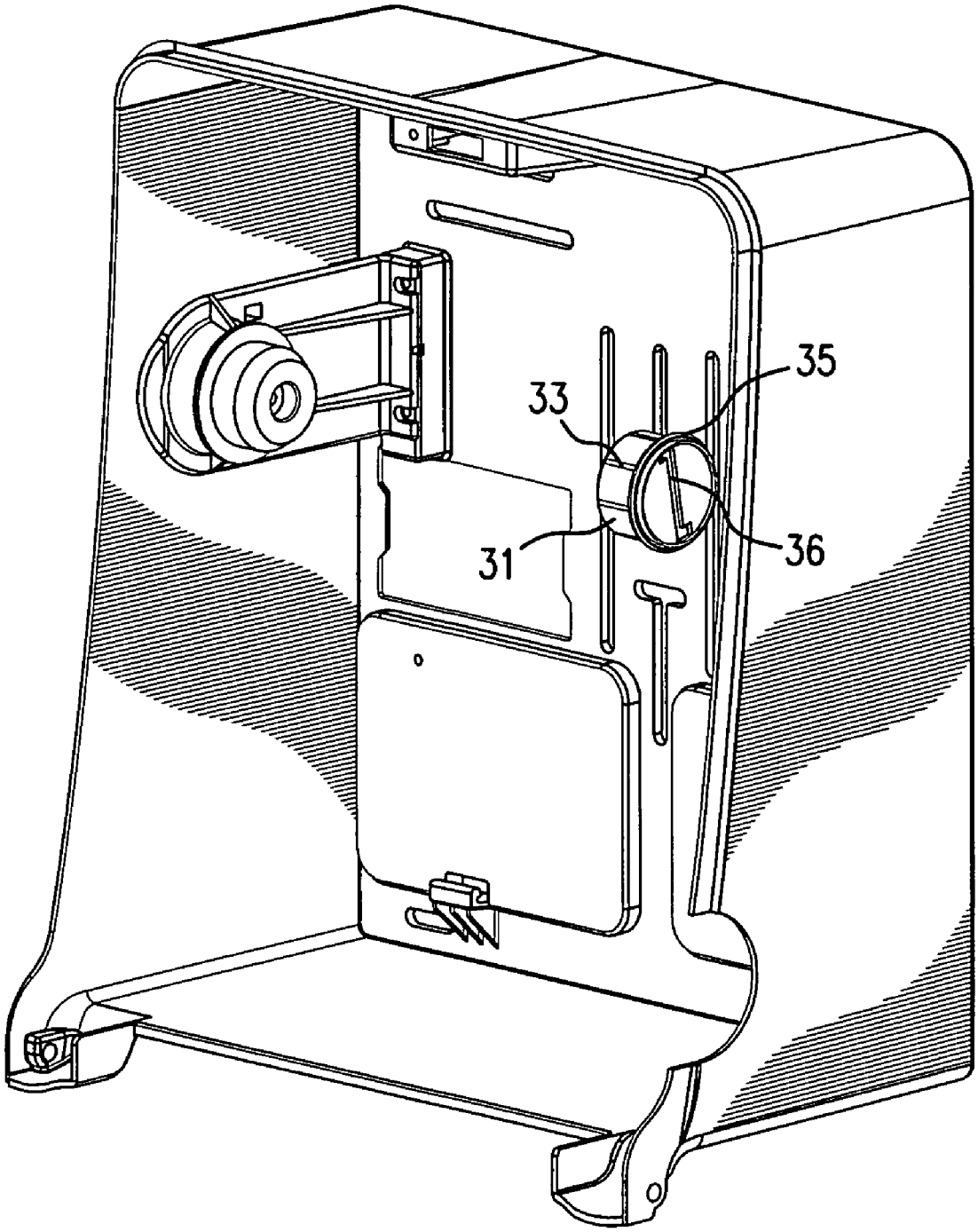
FIG. 3 is a perspective view of an embodiment of a female plug according to the invention.

As seen in FIG. 3, the plug 31 may include a first flange 35 that prevents the plug 31 from being pushed completely inside the core 15. In a preferred embodiment, the plug 31 is substantially cylindrical and has an outer diameter slightly smaller than an inside diameter of the core 15, while the diameter of the first flange 35 is slightly larger than the inside diameter of the core 15. Of course, other ways of preventing the plug 31 from being pushed inside the core 15 are contemplated such as the plug 31 having a truncated conical shape with the largest outside diameter being larger than that of the inside diameter of the core 15. In addition, the first flange 35 need not extend fully around the plug and may only extend partially around the plug.

In addition to the first flange 35, the plug 31 also has an opening 36 in at least one end thereof. In the embodiment of FIGS. 2 and 3, the opening 36 is substantially Z-shaped. Although the shape of the opening is not limited, nevertheless, it is preferred that the opening is not circular. Thus, the opening 36 may be substantially bone-shaped or may be an elongate slot with a circular central portion having a diameter wider than the slot. In this way, not only is it harder for an unauthorized person to use a plug other than the intended plug in the system, but also, the mating connection of the male key 40 and the female plug 31 ensures that the roll will rotate smoothly on the support arm 42.

The plug 31 may also include a plurality of longitudinally extending ribs 33 about a circumference of the body of the plug 31. The ribs 33 assist in maintaining the plug 31 within the core 15.

Figure 4:
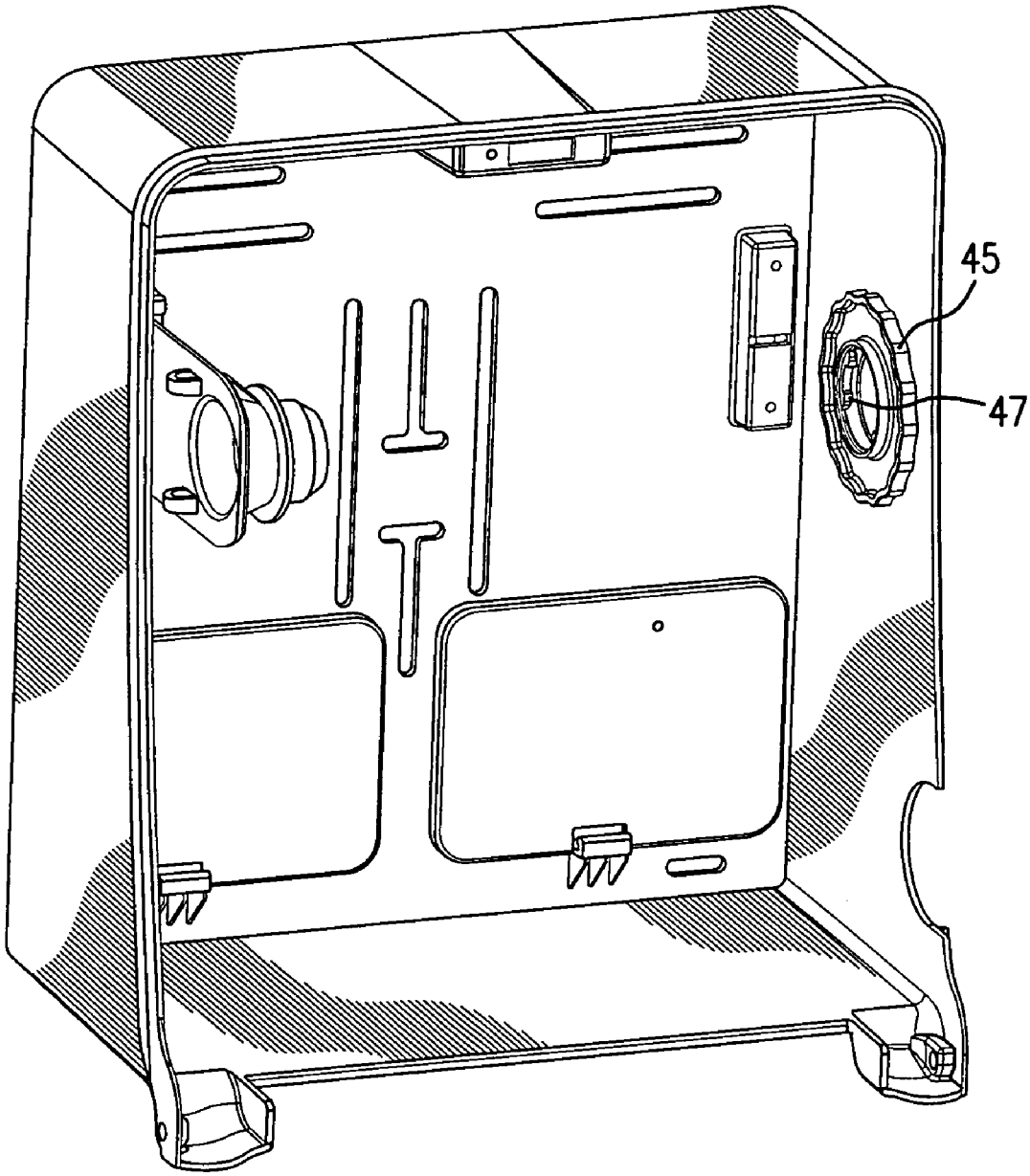
FIG. 4 is a perspective view of an alignment wheel according to the invention.
Figure 5:
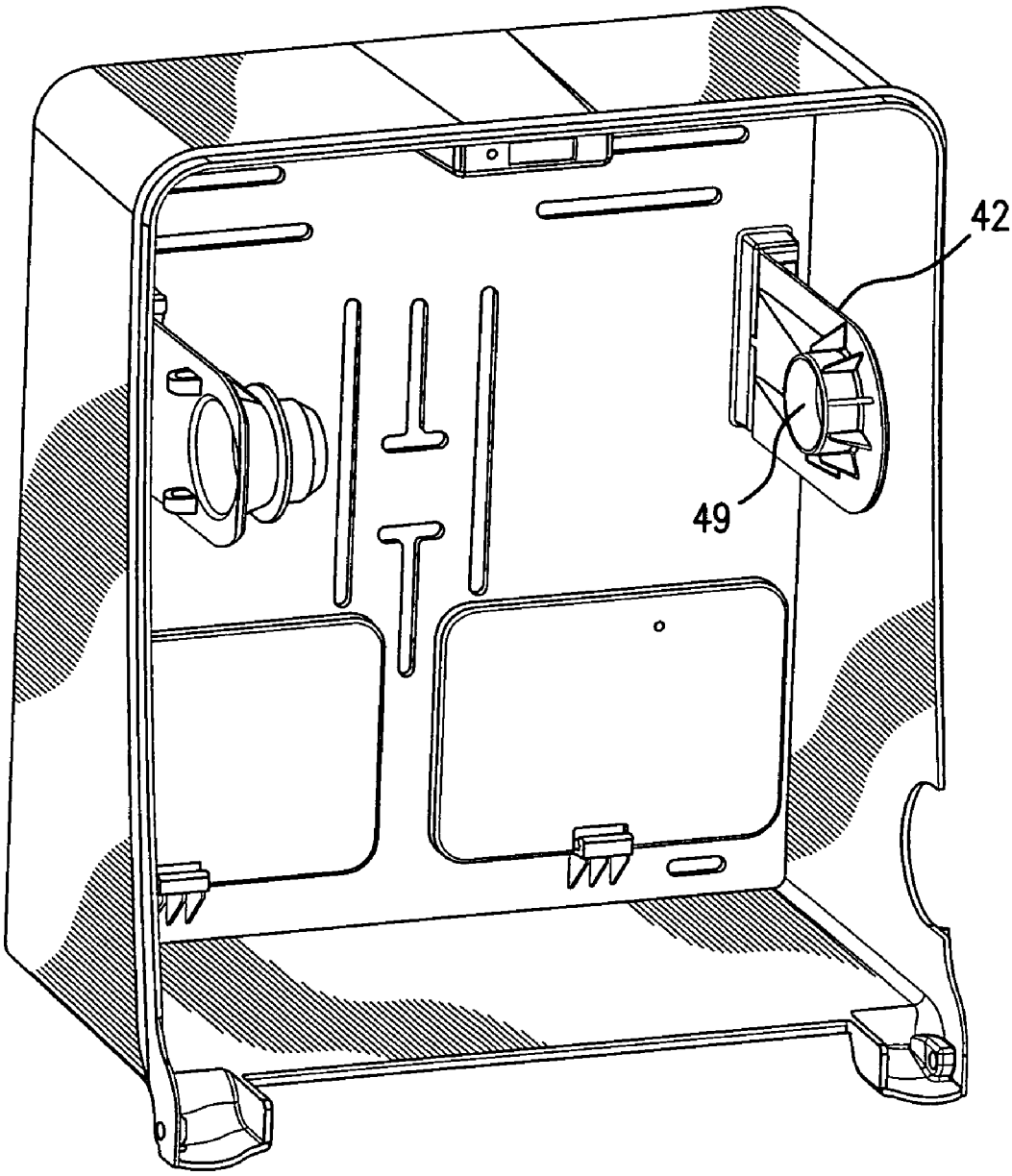
FIG. 5 is a perspective view showing a support arm.
Figure 6:
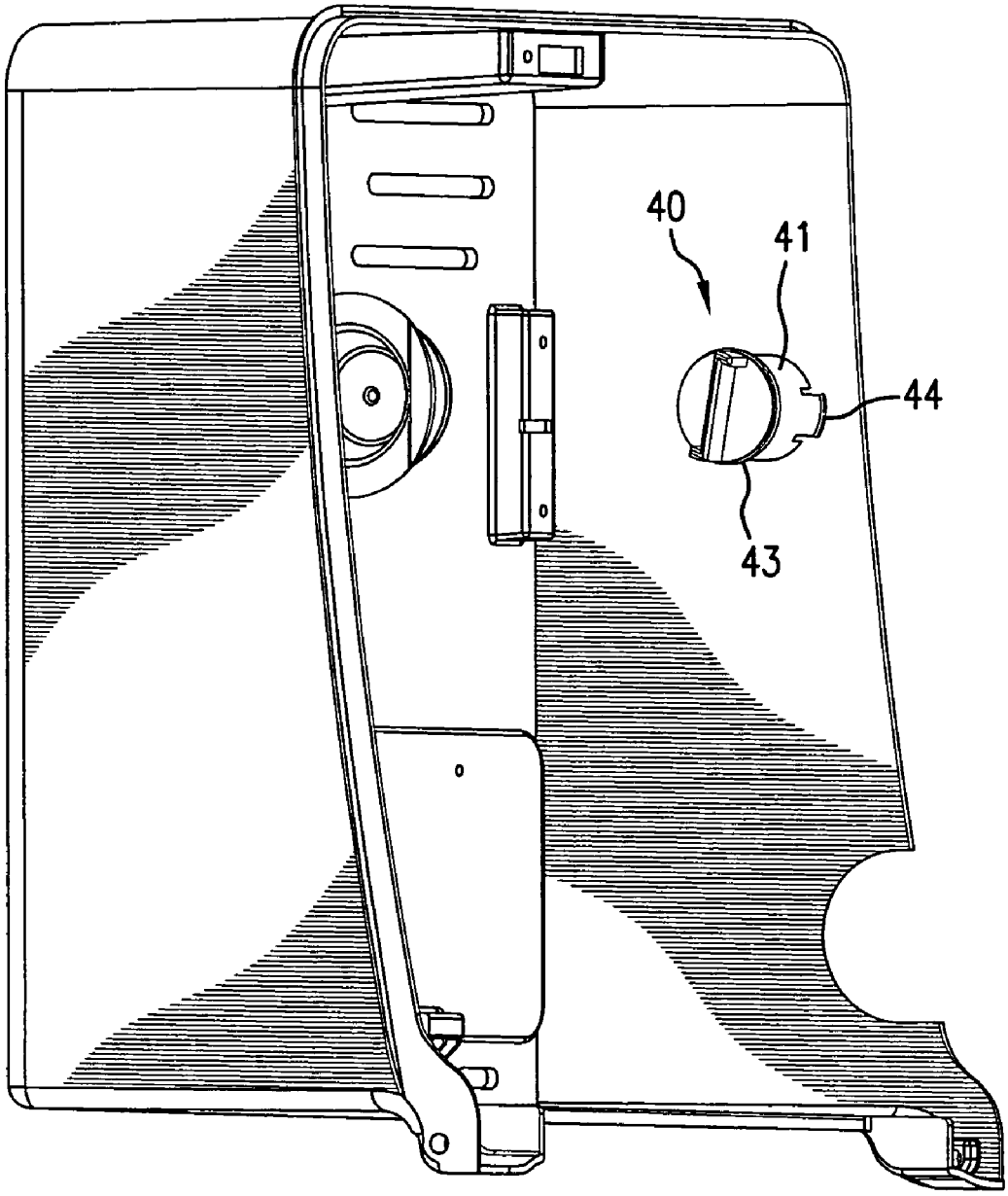
FIG. 6 is perspective view showing a male key.

In the embodiment of FIGS. 1-6, the plug 31 is part of a female plug system 30 that also includes a key member 40 having a complimentary male shape to that of female plug 31 as seen in FIGS. 2 and 6 and that inserts into the non-circular opening 36. The key member 40 is rotatably connected to a wall of the housing 20. In the embodiment of FIG. 1, the key member 40 is rotatable within a support arm 42 connected to the rear wall 22. However, the support arm 42 might be connected to one of the side walls or a support may be connected to each side wall.

The plug system 30 may also include an alignment member 45. In a preferred embodiment, the key member 40 is coaxial with the alignment member 45. As seen in the embodiment of FIGS. 1, 5 and 6, the key member 40 extends partially through the support arm 42 of the plug system 30. A second flange 43 on the key member 40 prevents the key member 40 from completely passing through the support arm 42. The key member also has two opposing arms 44 (only one of the arms being visible in FIG. 6). The arms 44 snap-fit into lugs 47 on an inner portion of the alignment member 45. See FIG. 4. In this way, the support arm 42 is between the key member 40 and the alignment member, with body portion 41 of the key member 40 freely rotating within the opening 49 of the support arm 42.

In the embodiment of FIG. 4, the alignment member 45 is annular. However, the alignment member 45 may be any shape that a user can rotate to align the key member 40 with the opening 36, such as octagonal, oval or star-shaped.

In operation, the absorbent material is removed from the roll of absorbent material 10 until the roll 10 is depleted or substantially depleted. Hopefully not long thereafter, a maintenance person will note that the roll 10 is spent or substantially spent and must be replaced with a new roll. To replace the roll, the maintenance person opens the cover 24 of the dispenser housing 20. The maintenance person removes the spent or substantially spent roll and places a new roll into the housing.

Placing the new roll of absorbent material into the dispenser 1 includes inserting a first end of the core 15 onto a boss 50 extending from boss arm 52 that in a preferred embodiment extends from the rear wall of the dispenser as seen in FIG. 1. Consistent with the conventional practice of shipping the rolls with a plug therein, a second end of core 15 preferably already has a plug 31 therein, inserted by the manufacturer/roll distributor. Of course, the maintenance person could insert a plug 31 into the core 15, if no plug was there, even using the plug from the spent roll in the new roll.

The maintenance person then rotates the male key member 40 having a mating shape to the opening 36 until the male key member 40 and the opening 36 are aligned. As described above, rotating alignment member 45 is the preferred manner for performing the rotation of the male key member 40.

Once the male key member 40 and the opening 36 are aligned, the maintenance person inserts the male key into the opening and closes the dispenser 1. Alternatively, the male key member 40 may be inserted into the opening 36 before the first end of the core is inserted onto the boss 50.

Figure 7:
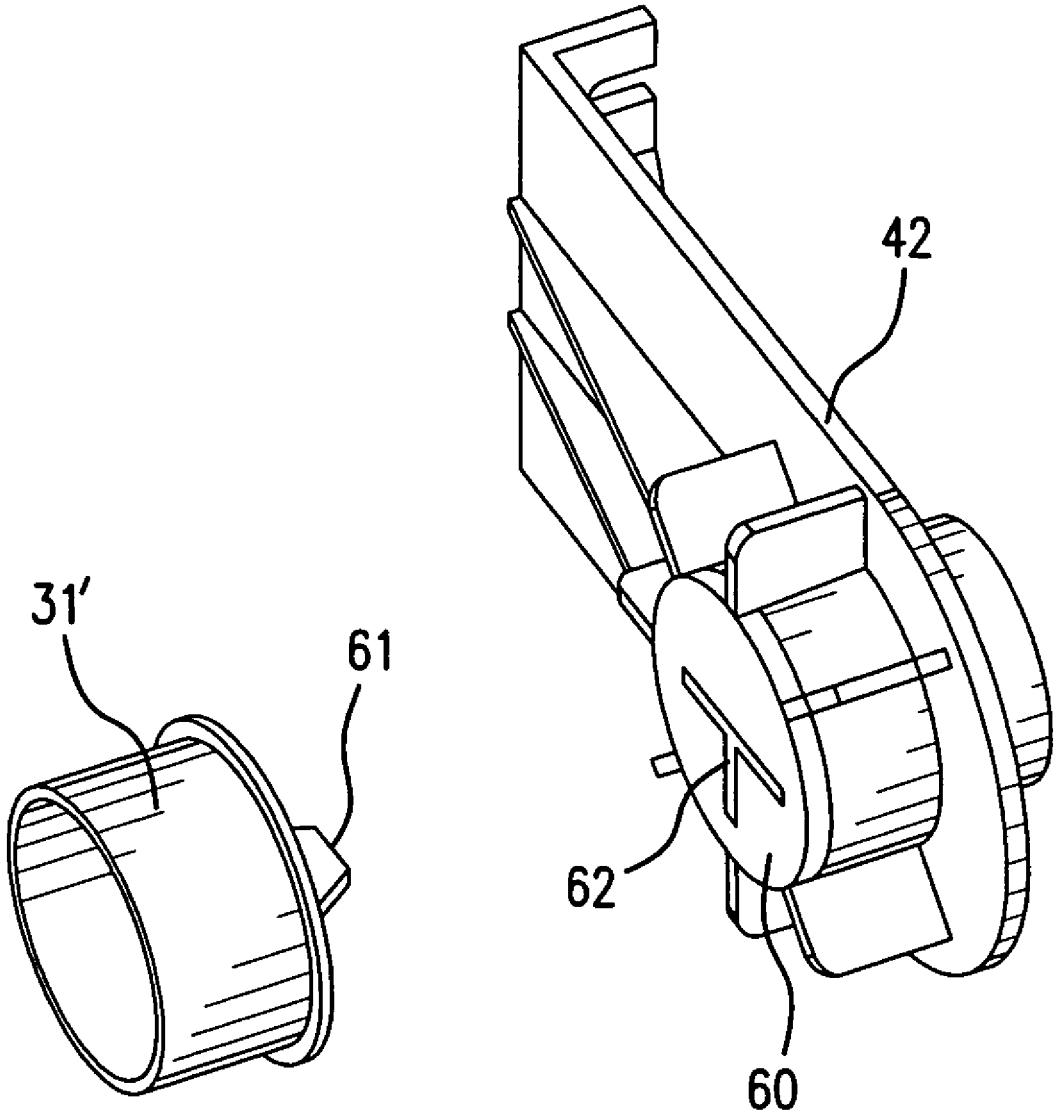
FIG. 7 is a perspective view of an embodiment having a male plug.

In the embodiment of FIGS. 1-6 described above, the plug 31 is a female plug preferably having a non-circular opening 36. However, the plug might also be a non-cylindrical male plug 31' having a male plug member 61 as seen in FIG. 7 that engages a female rotatable hub 60 having a mating opening 62 that corresponds to the male plug member 61. Similar to the male key member 40, the female rotatable hub rotates within support arm 42. As with the female plug 31 and male key member 40, the male plug member 61 and the opening 62 are not limited to the T-shaped embodiment that is shown in FIG. 7 and any mating shapes are contemplated by the present invention.

As described above, in the presently preferred embodiment of the invention, each of the new rolls of absorbent material that are to be placed into the dispenser may come pre-packaged with the plug 31 or 31' in only one end of the roll to assist in easy installation by making the roll insertable in only one orientation.

In a preferred embodiment, the plug 31, 31' is an injected molded plastic component. In the female plug embodiment, by not having the male axle, such component is easier to mold than conventional plugs. In addition, by not having the male axle, the special packaging that acts to protect the male axle during shipping is not required. Thus, there is not only a cost saving due to such material not being manufactured, but also such material need not be disposed of as waste.

Moreover, both the male and female plugs of the invention are sufficiently resistant to breakage or deformation. In the female plug there is no protruding element to break, while in the male plug embodiments of the present invention, the male plug has an increased lateral thickness to provide sufficient resistant to breakage or deformation as opposed to the male pins of the prior art.

In a preferred male plug embodiment, a lateral or radial dimension of the male plug member 61 is greater than the axial extent of such plug, and is preferably greater by a ratio of at least 2:1, more preferably at least 3:1. Alternatively, the male plug member may have a relatively short axial length (as compared to the prior art) to be sufficiently resistant to breakage or deformation.

The invention has been described in detail with respect to presently preferred embodiments. However, those of ordinary skill in the art would appreciate that changes or modifications may be made without departing from the spirit of the invention. The invention should not be limited to the disclosed embodiments and rather should be defined by the appended claims.

What is claimed is:

1. A dispenser for dispensing sheets of material from a roll of absorbent material, comprising:

a dispenser housing;

a roll of absorbent material wound around a core and rotatably mounted within said dispenser housing;

a plug insertable at least part way into at least one end of said core, said plug having a first shaped portion at one end face thereof;

a hub member having a complimentary shape that interlocks with said first shaped portion; and a support arm extending from a rear wall of said dispenser housing, said hub member being rotatable within said support arm.

2. The dispenser as claimed in claim 1, further comprising an alignment member coaxial with said hub member.

3. The dispenser as claimed in claim 2, wherein the alignment member is annular.

4. The dispenser as claimed in claim 2, wherein the first shaped member is a non-circular opening.

5. The dispenser as claimed in claim 4, wherein said plug includes a flange that prevents said plug from being pushed completely inside said core.

6. The dispenser as claimed in claim 4, wherein the non-circular opening is substantially Z-shaped and is coplanar with said flange.

7. The dispenser as claimed in claim 4, wherein the non-circular opening is an elongate slot with a circular central portion having a diameter wider than said slot.

8. The dispenser as claimed in claim 2, wherein said hub member comprises arms that extend through said support arm and releasably engage said alignment member.

9. The dispenser as claimed in claim 1, wherein the first shaped member is an opening and said hub member is a male member.

10. The dispenser as claimed in claim 9, wherein said opening is non-circular.

11. The dispenser as claimed in claim 1, wherein said hub member has an exposed portion disposed on one side of said arm by which said hub member may be grasped to rotate said hub member to the extent necessary to mate with said core.

* * * * *